United States Patent [19]

Stockmar

[11] Patent Number: 4,458,657

[45] Date of Patent: Jul. 10, 1984

[54] COMPOUND ARCHERY BOW

[75] Inventor: Dean W. Stockmar, Aurora, Colo.

[73] Assignee: Kenneth Holtman, Denver, Colo.

[21] Appl. No.: 271,189

[22] Filed: Jun. 8, 1981

[51] Int. Cl.[3] ..... F41B 5/00

[52] U.S. Cl. ..... 124/17

[58] Field of Search ..... 124/24 R, 23 R, 90, 124/88, 41 A

[56] References Cited

U.S. PATENT DOCUMENTS

| | | | |
|---|---|---|---|
| 2,307,021 | 1/1943 | Cordrey et al. | 124/23 R |
| 3,486,695 | 12/1969 | Allen . | |
| 3,518,980 | 7/1970 | Hamm | 124/24 R X |
| 3,851,638 | 12/1974 | Alexander | 124/24 R |
| 3,854,467 | 12/1974 | Hofmeister . | |
| 4,005,696 | 2/1977 | Jennings . | |
| 4,077,385 | 3/1978 | Fredrickson . | |
| 4,079,722 | 3/1978 | Griggs . | |
| 4,103,667 | 8/1978 | Shepley . | |
| 4,300,521 | 11/1981 | Schmitt | 124/23 R |

*Primary Examiner*—Richard J. Apley

*Assistant Examiner*—William R. Browne

*Attorney, Agent, or Firm*—Young & Martin

[57] ABSTRACT

A compound archery bow has a main frame with a pair of rigid arms extending outwardly from a central handle portion. A cam member is rotatably journaled on the end of each arm and a bowstring is connectable between the cam members. A resilient member, preferably a pair of rubber tubes, interconnects the main frame and each cam member at a point offset from its axis. When the cam rotates as the bowstring is drawn, the point of attachment of the resilient member to the cam member is brought into general alignment with the cam axle and the point of attachment of the resilient member to the main frame. Forces generated on the cam member by the resilient member at full draw are thus substantially radial. Both points of attachment of the resilient members are adjustable, and the applied tension of the resilient members is adjustable as well. A pulley is rigidly connected to each cam member, and the pulleys are interconnected by a cable to cause both cam members to rotate correspondingly.

23 Claims, 11 Drawing Figures

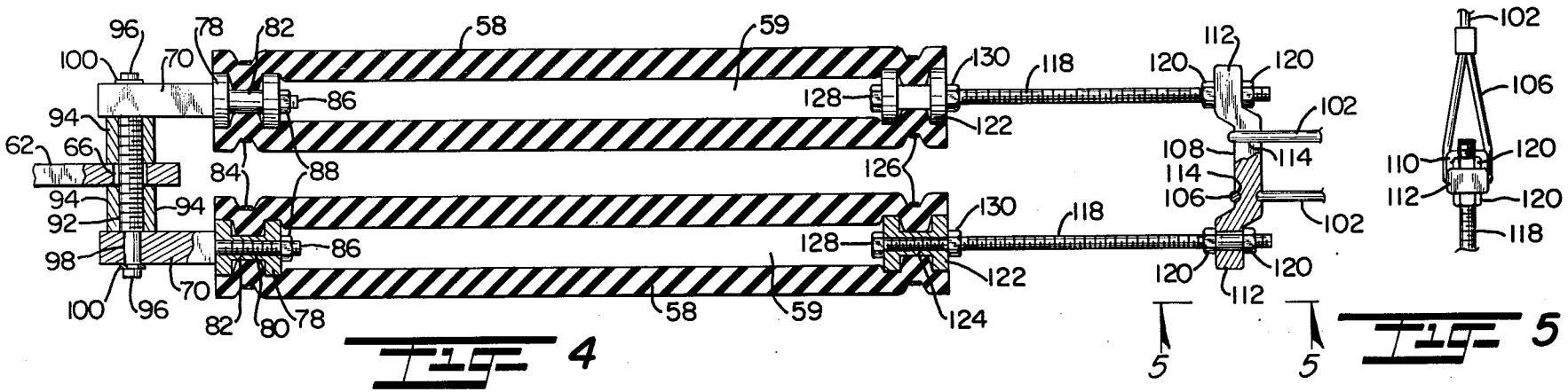
FIG. 4
FIG. 5
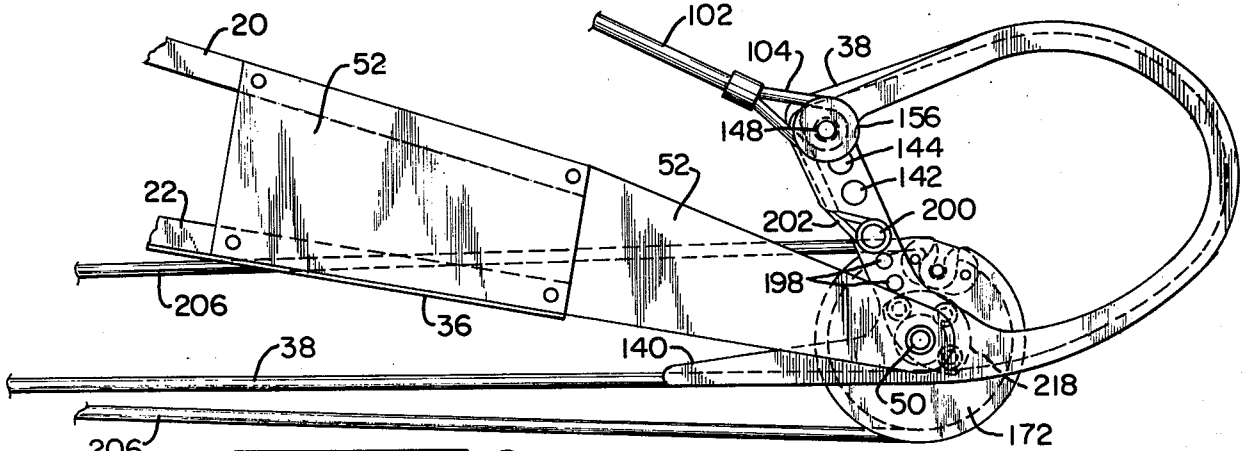
FIG. 6
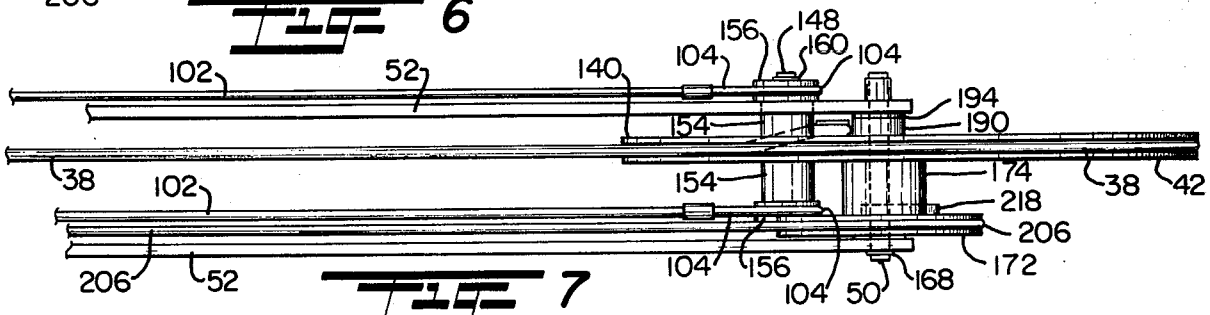
FIG. 7
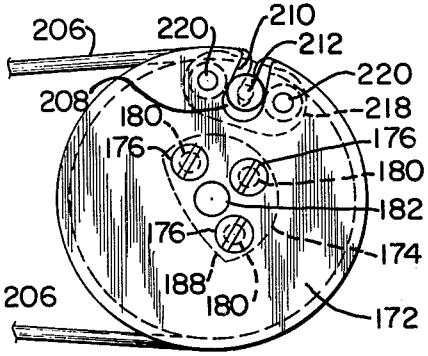
FIG. 10

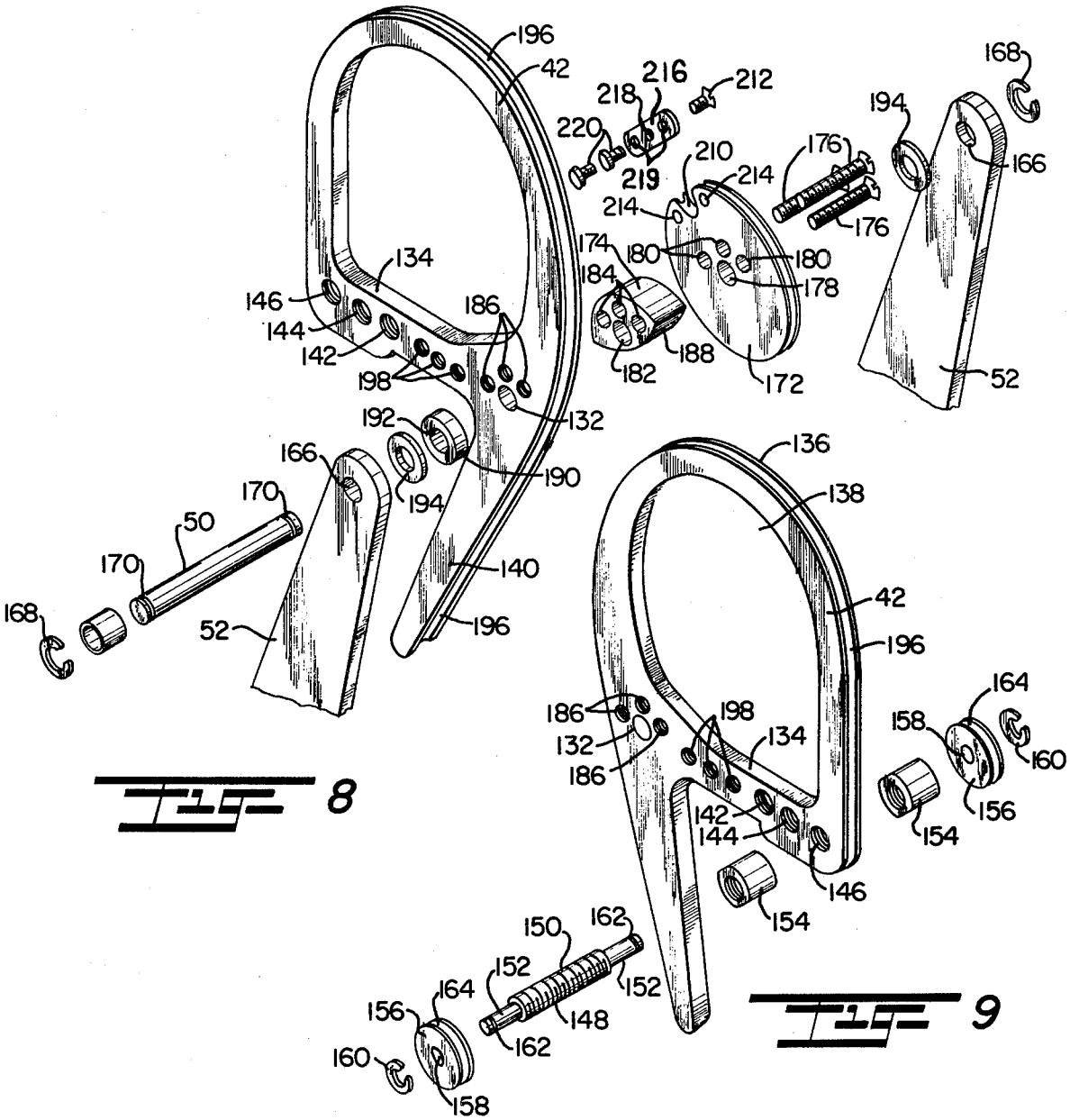
FIG. 8
FIG. 9
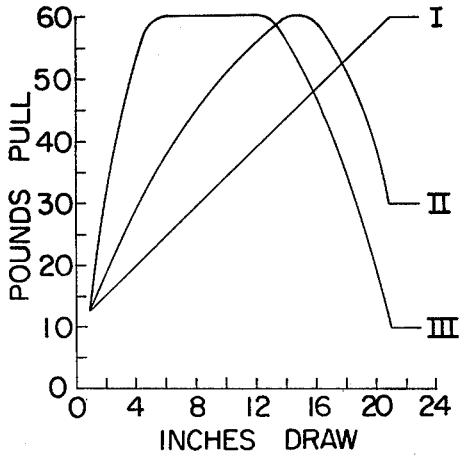
FIG. 11

COMPOUND ARCHERY BOW

BACKGROUND OF THE INVENTION

The present invention relates to archery equipment, and more particularly to an improved compound bow having a novel bowstring tensioning assembly that exhibits superior dropoff characteristics over existing conventional recurve and compound bows.

As is well known, conventional bows, such as a recurve bow, comprise a main body having oppositely extended arms, and a bowstring is attached to the free ends of the arms and is held under tension by the resilient action of the arms. In use, as the string is drawn back by an archer, the force required to draw the bowstring from its initial position to its drawn position increases with the distance it is drawn. To retain the bowstring in its drawn position thus requires a substantial amount of force, and is quite tiring to the archer who desires to hold the bow in its drawn position for any substantial amount of time, for example, when the archer is hunting. Compound bows have sought to solve this problem by reducing the effort required to maintain the bow in its drawn position. To accomplish this, a pair of cams or eccentric pulleys are rotatably mounted on the free ends of the bow arms with the bowstring attached to these cams. Once again, the resilient nature of the arms provides the force necessary to maintain tension on the bowstring, and the force to draw the bowstring increases as it is moved from its initial position through an intermediate position toward its fully drawn position. However, by providing cams or eccentric members, the cam members rotate immediately prior to reaching the fully drawn position. This reduces the force required to maintain the bowstring at its fully drawn position. Indeed, compound bows of the prior art have accomplished this dropoff characteristic to a degree that the force required to hold the bowstring fully drawn is approximately one half the maximum force during the drawing operation.

An archer must still employ a fairly powerful bow when hunting, however, and often the hunter requires a bow that has a drawing force on the order of sixty or more pounds. Thus, even a compound bow with a fifty percent dropoff characteristic requires a pull of thirty pounds or more to resist the release of the bowstring from its fully drawn position supporting an arrow for launching. In many cases, the hunter is required to hold the bowstring at its fully drawn position for periods up to two minutes while stalking game so that this can become quite tiring and indeed decrease the qccuracy of the archer due to fatigue despite the improvements of the compound bow over a conventional bow. A conventional recurve bow is naturally more tiring.

The dropoff characteristics of a bow can also affect the weight of an arrow that may be launched. It has long been known that an arrow must arch or fluctuate about its spine as it is launched and as it continues in flight in order to travel on a true path. An arrow which is light in weight typically will be more susceptible to fluctuation than a heavier arrow. Since too much fluctuation is undesirable, a bowstring that accelerates a lighter arrow too rapidly can introduce too much fluctuation so that a heavier arrow must be employed. For the same power of bow, then, this reduces the energy of the arrow since the energy is linearly proportional to the square of the velocity. By having a more gradual initial acceleration a lighter arrow may be used without causing over fluctuation, with this arrow attaining a greater velocity and thus an increased energy. Therefore, it is desirable that a bow have sufficient power but exhibit a dropoff that occurs more gradually to a level as low as possible in the fully drawn bowstring position.

SUMMARY OF THE INVENTION

It is an object of the present invention to provide a novel archery bow which exhibits dropoff characteristics so that less than one half of the maximum drawing force is required to maintain the bowstring at its fully drawn position.

Another object of the present invention is to provide a novel archery bow such that the bowstring exhibits a more gradual dropoff curve from its maximum drawing force to the force necessary to hold its fully drawn position.

Yet another object of the present invention is to provide a novel archery bow which has a novel bowstring tensioning mechanism so that forces applied to the bowstring independent of the resilient characteristics of the bow arms.

It is still another object of the present invention to provide a novel archery bow having a rigid frame and arm assembly with an improved string tensioning system which is adjustible to vary the tension on the bowstring and which provides improved drawing force dropoff characteristics over conventional, recurve and compound bows.

To accomplish these objects, the archery bow according to the preferred imbodiment of the present invention includes a main frame having a pair of arms extending therefrom with this frame and arm assembly being rigid. A cam member is rotatably mounted on the free end of each arm and a bowstring is attachable between the cam members so that, as the bowstring is drawn, each cam member rotates about its axle. A novel bowstring tensioning system is provided which resists rotation of the cam members by exerting torque thereon and this system includes a spring means in the form of resilient tubes which are mounted between a central portion of the main frame and each respective cam member at a point offset from its axle. With this construction, the rubber tubes resiliently resist rotation of the cam members as the string is drawn by exerting torque which applies tension to the bowstring. Each cam member is configured so that, as the bowstring approaches its fully drawn position, the attachment point of the rubber tube to the cam, the cam axle, and the point of attachment of the rubber tube to the main frame generally align so that the force applied to the cam by the rubber tube is substantially radial in a direction toward the axle of the cam. Since the bow's arms are rigid, the torque force is greatly reduced which in turn provides superior dropoff characteristics for the bowstring in its fully drawn position. Further, by configuring the cam to have a varying radius of curvature, the dropoff force curve for the bowstring can be controlled so that dropoff occurs more gradually to a level substantially less than one half of the maximum force required to draw the bowstring while maintaining the power of the bow.

The preferred imbodiment of the present invention also includes structure allowing the adjustable positioning of the point of attachment of each rubber tube to the main frame of the bow and adjustable positioning of the attachment point of each rubber tube to each cam member. Further, a pulley is rigidly secured to each cam member with these pulleys interconnected by a cable rigging to rotate the cam members simultaneously so that a corresponding force is applied to both ends of the bowstring at all times.

It should be appreciated that it is possible to construct a bow incorporating the main features of this invention utilizing a single cam member or utilizing for a different attachment assembly for the spring means and to employ different materials than those described with respect to the preferred imbodiment without departing from the scope of this invention. Other objects, advantages and features of the present invention will become more readily appreciated and understood when taken together with the following detailed description in conjunction with the accompanying drawings, in which:

BRIEF DESCRIPTION OF THE DRAWINGS

FIG. 4 is a front view in partial cross-section showing assembly according to the preferred imbodiment of the present invention;

FIG. 5 is a side view in elevation of a portion of the rubber tube assembly taken about lines 5—5 of FIG. 4;

FIG. 6 is a side view in elevation of the cam assembly according to the preferred imbodiment of the present invention;

FIG. 7 is an end view in elevation of the cam assembly shown in FIG. 6;

FIG. 8 is an exploded perspective view of the cam assembly shown in FIG. 6;

FIG. 9 is an exploded perspective view of the mounting system for the rubber tube assembly of FIG. 4 to the cam assembly of FIG. 6;

FIG. 11 is a side view in elevation of a cam pulley shown according to the preferred imbodiment of the present invention; and FIG. 11 is a graph of the force necessary to draw the bowstring as a function of distance the string is drawn for three types of bows, including the present invention.

DETAILED DESCRIPTION OF THE PREFERRED IMBODIMENT

Figure 1:
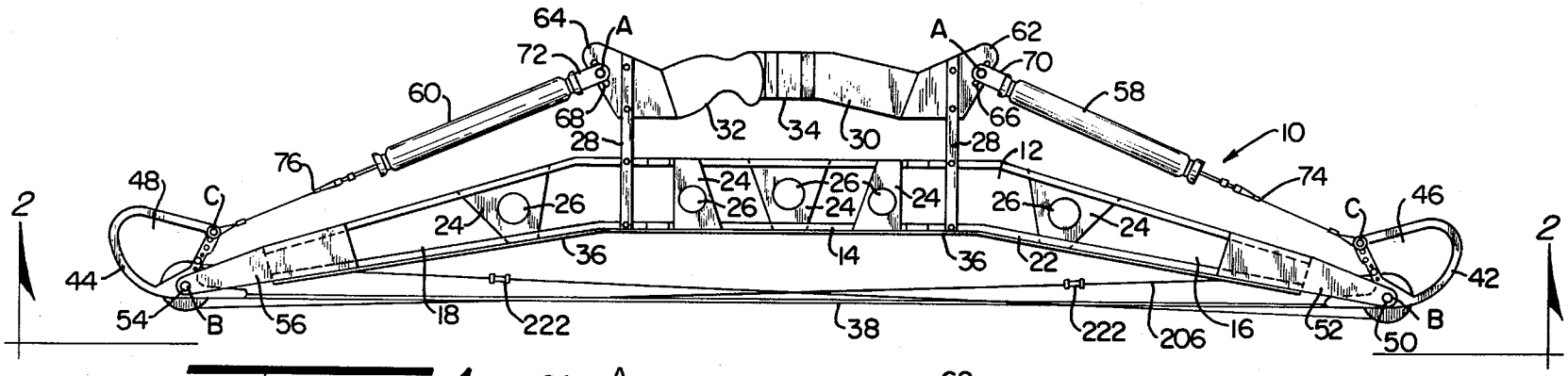
FIG. 1 is a side view in elevation of the archery bow according to the preferred embodiment of the present invention as shown with the bowstring in its normal position.
Figure 3:
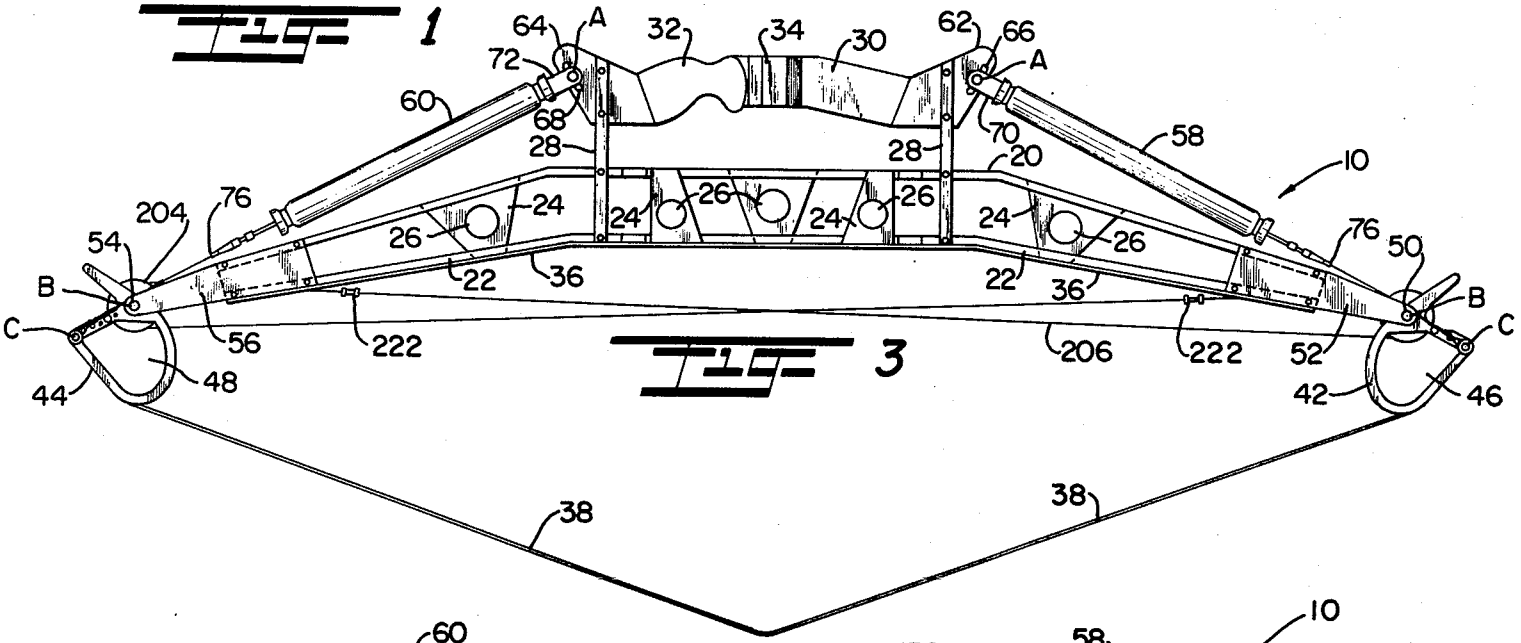
FIG. 3 is a side view in elevation of the preferred embodiment of the present invention showing the bowstring in its fully drawn position.
Figure 2:
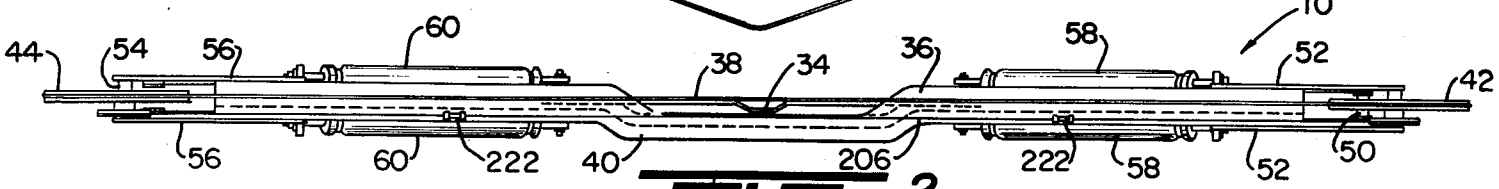
FIG. 2 is an end elevational view taken about lines 2—2 of FIG. 1.

The present invention relates to an improved archery bow, and more specifically, to an archery bow similar to a conventional compound bow but which includes a novel bowstring tensioning mechanism to provide improved draw force dropoff characteristics when a bowstring is fully drawn. As is shown in FIGS. 1, 2 and 3, archery bow 10 comprises a main frame 12 having a central handle portion 14 and a pair of outwardly extending arms 16 and 18 which are slightly angled with respect to central handle 14. Frame 12 is constructed from a pair of rigid aluminum bars 20 and 22 oriented along each edge with bars 20 and 22 being mounted to one another by a plurality of support brackets 24, each having a hole 26. Bars 20 and 22 are further connected by a pair of handle support members 28 which are rigid aluminum bars that extend perpendicularly to bars 20 and 22 at handle portion 14. A handle bracket 30 is mounted between support members 28 substantially parallel to central handle portion 14 of main frame 12. An arrow guide 34 is mounted at the mid-portion of handle bracket 30 and a handle 32 is mounted for manual gripping between arrow guide 34 and a lower one of support members 28. An elongated rib 36, best seen in FIG. 2 runs the entire length of frame 12 and is attached to bar 22 to give frame 12 lateral support to prevent the frame 12 from flexing in a direction away from the plane of frame 12 as the bowstring is drawn. As is shown in FIG. 2, bars 20 and 22 as well as rib 36 each has a central offset portion 40 corresponding to handle portion 14 so that it is not in the path of an arrow positioned between bowstring 38 and arrow guide 34 for launching. While in the preferred embodiment, the various elements of frame 12 are assembled by means of rivets or screws, it should be appreciated that it could be cast as a single element or connected together in any other convenient manner known in the art. It is desirable, however, that all parts of bow 10 be constructed of strong, lightweight materials.

Bowstring 38 is supported by cam members 42 and 44 formed as a closed curve or rim having a central opening 46 and 48 respectively. The attachment of bowstring 38 to cam members 42 and 44 is described in greater detail below, but it should be appreciated that cam member 42 is mounted on an axle 50 which is journaled between a pair of cam brackets 52 which are mounted to arm 16 on opposite sides of bars 20 and 22. Likewise, cam 44 is mounted to axle 54 which extends between cam brackets 56 which are in turn secured on opposite sides of bars 20 and 22 to arm 18. Cam members 42 and 44 are rotatable between a first position shown in FIG. 1, wherein bowstring 38 is in its initial or normal position, and a second position shown in FIG. 3 wherein bowstring 38 is fully drawn for launching an arrow (not shown).

In order to provide a tension on bowstring 38, a spring means is provided to bias cam members 42 and 44 into their first position shown in FIG. 1. It should be understood that various spring means as completely within the scope of this invention, and could include any type of resilient tube or strap or even metal springs. Specifically, though, a pair of rubber tubes 58 are associated with cam member 42 and a pair of rubber tubes 60 are associated with cam member 44 in the preferred embodiment. As is shown in FIGS. 1 and 3, handle bracket 30 has a pair of forwardly projecting wings 62 and 64 at opposite ends with wing 62 having an open slot 66 and wing 64 having an open slot 68. While the attachment of tubes 58 and 60 are discussed in greater detail below, it should be appreciated that tubes 58 have connecting arms 70 which are mounted by means of a bolt 96 in slot 66 while rubber tubes 60 each have a mounting arm 72 which is secured by a bolt 92 in slot 68. Tubes 58 are connected to cam member 42 by means of a cable assembly 74 at a point C radially offset from axle 50 as is shown in FIG. 1. Likewise, tubes 60 are connected to cam member 44 at a similar point C radially offset from axle 54 by means of a cable assembly 76.

Since rubber tubes 60 are mounted to arm 18 in a manner identical to that of the mounting of rubber tubes 58 to arm 14 and cam member 42, it is only necessary to describe the mounting in greater detail with respect to rubber tubes 58. This mounting is shown in FIGS. 4, 5 and 6 with the mounting of rubber tubes 58 to handle bracket 30 best shown in FIG. 4. As may be seen, each tube 58 has a hollow interior 59 which receives a metal spool 78 that has an axial bore 80 through its center. Since metal spool 78 has a reduced mid-portion 82, rubber tube 58 may be securely attached to spool 80 by means of a metal fastener band 84 which collapses a portion of tube 58 about mid-portion 82. Mounting arm 70 has an elongated post 76 which is adapted to extend through bore 80 of spool 78, and post 86 is threaded so that it may be snugly secured to spool 78 by means of a nut 88 in the interior 59 of tube 58.

Each mounting arm 70 has a transverse bore 90 extending transversely through an end opposite post 86 to permit releasable attachment of the rubber tube assembly to wing 62. As noted above, wing 62 has a slot 66. The mounting of each mounting arm 70 is accomplished by inserting a bolt 92 in slot 66 so that it projects an equal distance on either side of wing 62. Bolt 92 has a threaded mid-section so that a pair of nuts 94 may be tightened to clamp wing 62 between nuts 94 at the center of bolt 92. Nuts 94 also act as spacers to position mounting arms 70 a sufficient distance apart to allow free movement of tubes 58, and to this end, bolt 92 terminates in oppositely extending smooth cylindrical shanks 96. Each mounting arm 70 has a transverse hole 98 so that each shank 96 may extend therethrough. Each mounting arm 70 abuts a respective spacer nut 94, and each mounting arm 70 is retained on shank 96 by means of a C-clamp spring 100 mounted in a circumferential groove at each end of shanks 96. This assembly, then, securely connects one end of tubes 58 to handle bracket 30. It should be appreciated, also, that slot 66 permits a certain degree of lateral positional adjustment for bolt 92 which acts as an axle for mounting arms 70 so that bolt 92 may be selectively positioned in slot 66 and retained in position by the clamping action of spacer nuts 94.

As noted above, the end of each tube 58 opposite arm 70 is connected to cam member 42 by means of cable assembly 74. With more particularity, as is shown in FIGS. 4, 5 and 6, the free end of cable 102 adjacent cam member 42 terminates in a closed loop 104. The end of cable 102 opposite end loop 104 also terminates as a closed loop 106 which is secured to rubber tube 58 by mounting beam 108.

Mounting beam 108 is generally cylindrical in cross-section having a mid portion 110 and a pair of shoulders of 112 at its opposite ends. Two circumferential grooves 114 are cut in the opposite ends of mid-portion 110 adjacent each shoulder 112 so that beam 108 may be inserted through the opening in loops 106 so that each loop 106 may be mounted in a respective groove 114 as is shown in FIGS. 4 and 5. Each shoulder 112 has a hole 116 with holes 116 each being adapted to receive the end of an elongated threaded bolt 118 which is retained therein by a pair of nuts 120 each positioned on opposite sides of shoulder 112.

The opposite end of bolt 118 is mounted in the interior 59 of each rubber tube 58. In a manner similar to that described with respect to spool 78, a spool 122 is positioned in interior 59 of each tube 58 at an opposite end from spools 78. Each spool 122 has an axial bore 124, and spool 122 is retained in tube 58 by means of a metal clamping band 126 as is known in the art. With this construction, bolt 118 extends through bore 124 until its head 128 abuts spool 122, and a nut 130 is tightened so that spool 122 is clamped between nut 130 and head 128. In this manner, then, bolt 118 is secured to a respective tube 58 and beam 108 may be adjustably secured to bolts 118 by adjusting nuts 120.

Cable 102 is mounted to cam member 42 with the mounting assembly being best shown in FIG. 9. As may now be appreciated, cam member 42 is formed as a closed loop or rim having a radial portion 134 which extends radially outwardly from the axis of a bore 132 and an arch-shaped portion 136 whose legs are connected at opposite ends to radial portion 134 to form an opening 138. In this manner, then, radial portion 134 and arch portion 136 form a rim, and bore 132 acts as the rotation point for cam member 42. An elongated foot 140 lies in the plane of the rim formed by radial portion 134 and arch portion 136 and is oriented generally perpendicularly to radial portion 134 so that it extends radially outwardly from the axis of bore 132.

Bore 132 is adapted to receive axle 150 for permitting rotation of cam member 42 as described in greater detail below. The connection of cable 102 to cam 42, however, is provided by a mounting assembly mounted at the outer end of radial portion 134. Specifically, radial portion 134 is provided with three holes 142, 144 and 146 so that a bolt 148 having a threaded mid-portion 150 and smooth outer shanks 152 may be inserted through a selected one of holes 142, 144 and 146. Bolt 148 is releasibly yet securely mounted in a selected one of these holes by means of a pair of threaded nuts 154 mounted on either side of cam 42 with the thickness of cam 42 and the two nuts 154 corresponding to the length of threaded mid-portion 150. A spool 156 may then be mounted on opposite ends of bolt 148 such that an axial bore 158 of each spool 156 receives a respective smooth shank 152 of bolt 148. Spools 156 are each retained on bolt 148 by means of a C spring clamp 160 which mounts in a groove 162 formed circumferentially around each end of bolt 148.

Each cable 102 may now be mounted on this assembly by a respective spool 156. More particularly, each spool 156 has a circumferential channel 164 so that each loop 104 is placed in this channel 164. Since cables 104 are under tension, looped portions 104 are retained by this force in channels 164 as cam 42 rotates about axle 50. Since spools 156 are mounted on smooth shank portions 152 of bolt 148, they may freely rotate on bolt 148 as cam 42 is rotated.

As noted above, cam member 42 is mounted on axle 50, and this mounting is best shown in FIGS. 6, 7, and 8. With reference to FIG. 8, it may be seen that axle 50 is rotatably journaled in a pair of holes 166 provided at the free end of cam brackets 52 and is securely mounted therebetween by means of C spring clamps 168 which are releasibly received by circumferential grooves 170 formed at opposite ends of axle 50. In addition to cam 42, a pulley member 172 is mounted between cam brackets 52 with cam member 42 and pulley member 172 being positioned apart by spacer 174. Pulley member 172 is rigidly secured to cam 42 for common rotation therewith.

While it should be appreciated that cam 42, spacer 174 and pulley member 172 could be formed as a single unit, in the preferred imbodiment of the present invention they are formed as three separate elements which are secured together by means of counter-sunk screws 176 having heads counter-sunk in pulley member 172. More particularly, pulley member 172 has an axial bore 178 and three offset holes 180; spacer 182 has an axial bore 182 and three offset holes 184 corresponding to holes 180 of pulley member 172; and, cam member 42 has three holes 186 which are offset from axle bore 132 with holes 186 corresponding with holes 180 and 184.

Screws 176 thus extend through holes 180 and 184 and are threadably received in holes 186 to rigidly secure spacer 174 and pulley member 172 onto cam member 42 with bores 178 and 182 being aligned with axle bore 132 of cam member 42. Spacer 174 is generally semi-circular in a plane perpendicular to bore 182 so that it has a flattened edge surface 188 which is oriented as closely as possible to bore 182. Spacer 174 is mounted on cam member 42 so that the plane of flattened face 188 passes between elongated foot 140 and radial portion 134 of cam member 42. A circular spacer 190 having an axial bore 192 is then mounted on axle 50 on the side of cam member 42 opposite spacer 174. A pair of washers 194 are positioned on either side of this assembly so that the entire assembly may be mounted between cam brackets 52.

Bowstring 38 extends between cam members 42 and 44 as is shown in FIGS. 1 and 3, with the attachment of bowstring 38 being similar at both of its free ends. By way of example, the attachment of bowstring 38 to cam 42 is shown in FIG. 6 where it should be appreciated that cam 42 has a channel 196 that is continuous around its outer edge and along the edge of foot 140. Bowstring 38 is then positioned in channel 196 so that it extends first past foot 140, around arch portion 136 and then radially inwardly along radial portion 134 for approximately half the length of radial portion 134. Three threaded holes 198 are provided on radial portion 134 between hole 142 and axle bore 132. A screw post 200 may then be threaded into a select one of holes 198, and post 200 receives a looped end portion 202 of bowstring 38. Accordingly, bowstring 38 extends from post 200 around cam member 42 and elongated foot 140 through channel 196 and then projects between the ends of arms 16 and 18 to be mounted in a similar fashion onto cam member 44. Some compensation can be made for slight differences in the lengths of bowstring 38 since bowstring 38 is under tension, the tension prevents looped ends portions 202 from slipping off a respective post 200.

As noted above, cam member 42 has an associated pulley member 172, and it should be appreciated that cam member 44 likewise has a respective pulley member 204 with pulley members 172 and 204 being interconnected by a rigging cable 206. As is shown in FIG. 10, cable 206 extends around pulley 172 in its edged channel. With reference to FIG. 8, it should be appreciated that pulley 172 has a notch 210 formed at its edge and a pair of threaded holes 214 are formed on opposite sides of notch 210. An oval plate 216 has a central threaded hole 218 and a pair of holes 219, one on either side of hole 218. Plate 217 is adapted to be mounted to pulley member 172 by a pair of screws 220 which pass through holes 219 and are secured in holes 214. As is shown in FIGS. 8 and 10, cable 206 extends around the edge channel of 172 but has a reversed curved portion 208 which extends into notch 210 to provide a kink in cable 206. Cable 206 is then retained in notch 210 by means of a mounting screw 212 which is received by hole 218 from a side of pulley member 172 opposite plate 216. Attachment of cable 206 is accomplished in a similar manner to pulley member 204 and the cable is adjusted to proper length by means of clamps 222 as is known in the art. It should be noted that cable 206 crosses itself at a point midway between the ends of arms 16 and 18 so that, as a result of this rigging, pulley members 172 and 204 rotate in opposite directions.

The operation of the improved bow according to the present invention may now be more fully understood and appreciated by reference to FIGS. 1 and 3. By designating the point of attachment of tubes 58 and 60 to the respective wing 66 and 68 as point A, the location of axles 50 and 54 as point B, and the attachment point of cables 74 and 76 to a respective cam member 42 and 44 as point C, the improvement of the present invention may be more readily understood. Specifically, the force exerted by rubber tubes 58 and 60 on cam members 42 and 44 and thus onto bowstring 48 is in a line defined by points A and C. As is shown in FIG. 1, points A, B and C are not linear so that the tension along line AC exerts a torque about the rotational axis passing through point B for a respective cam member 42 and 44. However, as shown in FIG. 3, when bowstring 38 is fully drawn, points A, B and C generally align so that the force exerted along line AC is substantially radial with respect to points BC so that all torque forces are greatly reduced. Due to the physical dimensions of axles 50 and 54, of course, the torque does not go to zero.

It may now be appreciated, though, that as cam members 42 and 44 rotate about their respective axles, cables 102 and 104 rest against spacers 174 and 190 and more specifically, one of cables 102 will rest against a flat edge surface 188 of spacer 174. For this reason, flattened edge 188 is as close to the axis of axle 150 as possible and the radial distance from this axis to flattened face 188 should correspond to the radius of spacer 190. Further, it should be noted that the positioning of flattened edge face 188 is chosen so that flattened edge surface 188 is brought against one of cables 102 when a respective cam member is rotated.

Pulley members 172 and 204 cooperate with one another and their respective cam members 42 and 44 so that any imbalance in torques generated by tubes 58 and 60 are counteracted since pulley members 172 and 204 are forced to rotate simultaneously by cable 206. Accordingly, cam members 42 and 44 rotate simultaneously regardless of any imbalance in the torque forces so that a uniform tension is created on bowstring 38.

Elongated foot 140 provides a brake to prevent overreaction of the tensioning system when bowstring 38 is released from its drawn position. Since it is formed in a common plane of the main body of cam members 42 and 44, each foot 140 will slap against bowstring 38 as it returns to its initial position shown in FIG. 1 so that a reflective cam member 42 and 44 is prevented from rotating past its initial position due to the torque created by rubber tubes 58 and 60.

The improvement of the present invention is demonstrated in FIG. 10 which shows a graph of the pounds of pull or tension on bowstring 38 as a function of the distance it is moved from its initial position towards its fully drawn position. With reference to FIG. 10, the force graph of a recurve bow is designated as I, the force graph of a compound bow is designated as II, and the force graph of the present invention is designated as III. In the case of a recurve bow, I, the force curve is linear so that the pounds of pull required uniformly increases with the distance the bowstring is drawn. Accordingly, at full draw, such as shown in FIG. 3 of the present invention, a recurve bow has its maximum pull which can be very tiring to an archer who is forced to hold the bow at its fully drawn position (approximately 20 to 22 inches) for a substantial period of time. A compound bow, II, exhibits some dropoff characteristics. Specifically, as the compound bow is drawn, the force gradually increases to a maximum at about seventy percent of full draw after reaching its peak force, the force required to further draw the bowstring gradually decreases at full draw to a force approximately fifty percent of maximum force. For bows of corresponding strength, then, the compound bow has an advantage that, at full draw, the force required to maintain the bowstring's position is approximately one half of that required for a recurve bow.

The present invention, however, further improves this dropoff characteristic as is shown in FIG. 10. For the present bow, III, the force increases to a maximum during the initial twenty to thirty percent of the distance drawn after which it plateaus for approximately an additional thirty percent of the distance until it reaches fifty-five to sixty percent of full draw. At this point, due to the decreased torque on cam members 42 and 44, the force reduces almost linerally so that, at full draw, the force required to maintain the bowstring in fully drawn position is approximately fifteen percent that of maximum draw force. Accordingly, to maintain the present bow in its fully drawn position requires only approximately one third the force required for a compound bow of equal strength and only approximately one six that required for a recurve bow of equal strength. A further advantage is gained due to the lesser negative slope of the present bow's dropoff compared with the greater negative slope of the compound bow's dropoff since, when the arrow is released at full draw, the acceleration occurs less rapidly. Accordingly, a relatively light-weight arrow may be employed without causing over fluctuation of the spine, but, due to the plateau in force, the lighter arrow launched by the present invention will attain a greater velocity so that it attains a greater effective energy.

While the present invention has been described with some degree of particularity, it should be appreciated that the present invention is defined by the following claims construed in light of the prior art so that modifications or changes may be made to the preferred imbodiment of the present invention without departing from the inventive concepts contained herein.

I claim:

1. An archery bow adapted for supporting a bowstring for movement between an initial position of reduced tension and a full-drawn position of relatively increased tension, comprising;

a main frame having a centrally located handle and first and second rigid arms extending outwardly therefrom;

a cam member rotatably journaled on the free end of one of said first and second arms and adapted to mount said bowstring on said bow, and said cam member being movable between a first position of rotation about a pivot axis wherein said bowstring is in said initial position and a second position of rotation about said pivot axis wherein said bowstring is in full-drawn position; and bias means associated with said cam member for resiliently biasing said cam member into said first position of rotation, said bias means including a resilient member having one end secured to said main frame at a connection point and the other end mounting a flexible cable, said cable secure to said cam member at an attachment point located at a position offset from said pivot axis and out of the rotational plane of said cam member.

2. An archery bow according to claim 1 wherein said attachment point, said pivot axis and the connection point of said resilient member to said main frame are generally alligned when said cam member is in the second position of rotation.

3. An archery bow according to claim 1 wherein said resilient member is defined by an elongated rubber tube.

4. An archery bow according to claim 1 wherein the location of said attachment point on said cam member is selectively adjustable.

5. An archery bow according to claim 1 wherein the attachment point of said resilient member to said main frame is selectively adjustable.

6. An archery bow according to claim 1 including a cam member rotatably journaled on the free end of each said first and second arms, and including a pair of mounting members on said main frame on opposite sides of said handle, and bias means associated with each said cam member, each said bias means including a resilient member interconnecting a respective mounting member and a respective cam member at an attachment point on said cam member offset from its axis or rotation and out of the rotational plane of its respective cam member.

7. An archery bow according to claim 6 wherein each said resilient member is defined by a rubber tube.

8. A compound archery bow according to claim 1 including tension adjusting means associated with said bias means for adjusting the magnitude of force applied to said cam member by said bias means, said tension adjustment means positioned at a location remote from said cam member.

9. A compound archery bow adapted for supporting a bowstring, said bowstring movable between an initial state of reduced tension and a full-drawn state of relatively increased tension, comprising:

a main frame having a centrally located handle portion, a pair of arms extending outwardly from said handle portion, and a pair of mounting members secured to said main frame on opposite sides of said handle portion;

a cam member rotatably mounted on the free end of each said arm, said bowstring mountable to and between said cam members and each said cam member being rotatable between a first position corresponding to said initial state and a second position corresponding to said full-drawn state; and bias means interconnecting each mounting member and a respective one of said cam members at a location offset from its plane of rotation for forcibly yet resiliently resisting rotation of its respective cam member and biasing said cam member into said first position.

10. A compound archery bow according to claim 9 including force adjustment elements connected to each said bias means and adapted to selectively adjust the force applied by each said bias means to each respective said cam member.

11. A compound archery bow according to claim 9 wherein the force applied by said bias means to each said cam member is adjustable toward a radial direction when said cam member is moved from said first position to said second position.

12. A compound archery bow according to claim 9 wherein said bias means includes at least one resilient tube connected at one end to said mounting member and at the other end to the respective said cam member at a point offset from the rotational axis of said cam member.

13. A compound archery bow according to claim 12 wherein the point of connection of each said rubber tube to its respective mounting member is selectively positionable.

14. A compound archery bow according to claim 12 wherein the point of connection of each said rubber tube to its respective cam member is selectively positionable.

15. A compound archery bow according to claim 9 wherein said cam members are each mounted between a pair of bracket members mounted on each said arm on opposite sides of said frame and including a pulley member rigidly mounted to each said cam member for common rotation therewith, said pulley members being interconnected by a cable rigging so that rotation of one pulley member causes a corresponding rotation of the other said pulley member.

16. A compound archery bow according to claim 9 wherein each said cam member is formed as a rim defined by a radial portion extending radially outwardly from its axis of rotation and an arch portion interconnecting opposite ends of said radial portion, said cam member having an elongated foot extending outwardly from said axis of rotation in the plane of said rim at approximately a right angle to said radial portion.

17. A compound archery bow according to claim 16 wherein said cam member has a channel on its outward edge said channel extending outwardly from the midsection of said radial portion, around said arch portion and along said elongated foot, said channel adapted for receiving said bow- string therein from a point of attachment to said cam member at the midsection of said radial portion.

18. A compound archery bow according to claim 9 including a pair of spaced apart handle support members extending outwardly from said handle portion in the plane of said main frame, a handle bracket mounted between said handle support members, and a handle mounted on said handle bracket adapted to the manually grip by a user of said bow, said mounting members being attached on opposite ends of said handle bracket.

19. An archery bow adapted for launching arrows and the like, comprising:

a main frame having first and second outwardly extending arms and a centrally located handle portion;

a first cam member rotatably journaled on a first axle mounted to the free end of said first arm and a second cam member rotatably journaled on a second axle mounted on the free end of said second arm, said first and second cam members each rotatable between a first and second rotational positions;

first and second bias means associated with said first and second cam members, respectively, for resiliently biasing said first and second cam members into said first rotational position, said first and second bias means each including a resilient member secured at one end to said main frame and each having a cable assembly secured to the other end, each said cable assembly secured to its respective cam member at a location generally between the cam member axle and the point of attachment of its associated resilient member to the main frame when the cam member is in its first rotational position;

a bowstring mounted between said first and second cam members for receiving an arrow, said bowstring movable between an initial position wherein said first and second cam members are in said first rotational position and a full-drawn position wherein said first and second cam emmbers are in said second rotational position; and force adjustment means for selectively adjusting the magnitude of the biasing force applied by each said bias means to each of said cam members.

20. An archery bow according to claim 19 wherein each said cable assembly being selectively adjustable in length and including end portions mounted symmetrically on either side of its respective cam member.

21. An archery bow according to claim 20 wherein each said resilient member is releasably connected to the main frame at a variable pre-selected position and to its respective cam member at a variable pre-selected position.

22. An archery bow according to claim 19 wherein each said bias means includes a pair of resilient tubes associated with each one of said first and second cam members and its associated cable assembly includes a pair of cables mounted symmetrically about its respective cam member.

23. An archery bow according to claim 19 wherein the points of connection of each said resilient member to the main frame are to its respective cam member and generally aligned with the axle of its respective cam member when its respective cam member is in said second rotational position.

* * * * *